US007982111B2

(12) United States Patent
Fuller et al.

(10) Patent No.: US 7,982,111 B2
(45) Date of Patent: Jul. 19, 2011

(54) MUSICAL INSTRUMENT STABILIZING RESTRAINT

(76) Inventors: Zaidee Fuller, Wilson, WY (US); Rick Liu, Wilson, WY (US)

( * ) Notice: Subject to any disclaimer, the term of this patent is extended or adjusted under 35 U.S.C. 154(b) by 0 days.

(21) Appl. No.: 12/586,870

(22) Filed: Sep. 28, 2009

(65) Prior Publication Data

US 2010/0077900 A1 Apr. 1, 2010

Related U.S. Application Data

(60) Provisional application No. 61/194,716, filed on Sep. 30, 2008.

(51) Int. Cl.
*G10D 1/00* (2006.01)

(52) U.S. Cl. ..... 84/173

(58) Field of Classification Search ..... 84/173, 84/327, 329
See application file for complete search history.

(56) References Cited

U.S. PATENT DOCUMENTS

| | | | | |
|---|---|---|---|---|
| 4,018,129 | A * | 4/1977 | Hollander | 84/294 |
| 5,297,771 | A * | 3/1994 | Gilbert | 248/688 |
| 2004/0200750 | A1 * | 10/2004 | McAndrew | 206/446 |

* cited by examiner

*Primary Examiner* — Kimberly R Lockett
(74) *Attorney, Agent, or Firm* — Andrew D. Maslow

(57) ABSTRACT

A holder is provided for maintaining a device such as a musical instrument in a steady position on the floor upon which the device has been placed. The holder is attached to the floor but can be easily removed. The holder is provided with a recess adapted to receive the device. The recess is located on the top of the holder. The holder separates the device from the floor and comprises a substrate which has a pressure sensitive adhesive affixed to its bottom surface.

11 Claims, 2 Drawing Sheets

MUSICAL INSTRUMENT STABILIZING RESTRAINT

STATEMENT OF RELATED CASES

This application claims the benefit of earlier filed U.S. provisional patent application No. 61/194,716 filed Sep. 30, 2008 which is incorporated herein by reference.

FIELD OF THE INVENTION

The invention relates to the field of holders for musical or other instrument to prevent movement relative to the floor on which they are placed. More particularly the invention relates to a cello or bass endpin stabilizing restraint and floor protector.

BACKGROUND

The function of the cello or bass endpin is to provide a secure support on the floor for the instrument when it is being played by a performer. During the last hundred or so years of its universal acceptance and use, the cello endpin has undergone few changes.

Originally endpins were wooden rods with points. Subsequently, inventors created a type of pin that was widely accepted by cellists: an endpin that was an adjustable rod that is an integral part of the instrument, and that could be fully retracted into the bottom of the cello. This rod passes through a socket in end of the cello and is held in place by a thumb screw. This type of endpin has virtually become the standard world wide.

Because the cello is balanced on the endpin, the endpin must be secure from slipping on the floor. Cellists deal with this problem in a variety of ways. One solution is to sharpen the endpin sufficiently that it will lodge securely in the floor. This works only for a wooden or soft surfaced floor such as vinyl. One downside is that this technique will damage the floor. Another solution is a pad that protects the floor while providing a recessed hole or recepticle for the endpin. This option also works for endpins that are not sharp (i.e., student instruments). Anchoring such a pad can be accomplished by attaching it with a strap or strings to the legs of the performer's chair. These anchors work, but they require adjustment with strings or straps and a suitable chair leg. Endpin anchors that are not attached to the chair require some sort of non-stick surface that will not slide on the floor when subjected to the lateral force of the endpin. The prior art anchors are unreliable, resulting in sudden failure, slip, or creep, which can be very detrimental in performance.

Various endpin holders and floor protectors have been proposed over the vast number of years since the endpin became standard on cellos world-wide. Unless they are attached to the performer's chair, none of them have proved to be satisfactory.

The prior art is replete with endpin restraints to prevent damage to the floor as a result of direct contact with the free end of the endpin and prevent the endpin from sliding along the floor so as not to impair the performance of the cellist.

One such device is disclosed in U.S. Pat. No. 4,018,129 issued Apr. 19, 1997 to Hollander. In this patent, an end-pin holder for stringed instruments includes a back plate raised above the floor by pads or feet of cushioning material, and a top plate supported above the back plate and coupled thereto by a sound post. The top plate is provided with a socket to receive the end-pin.

Another device is set forth in U.S. Pat. No. 5,069,102 issued Dec. 3, 1991 to Wolf. This patent discloses an attachment including a carrier member separably connectable to the endpin, and a supporting member connected to the carrier member for supporting a hemispherical or conical floor contacting, elastomeric material.

Another device is shown in U.S. Pat. No. 5,696,338 issued Dec. 9, 1997 to Grissom. The Grissom floor protector has an upper surface having a plurality of raised supports forming pockets for supporting an endpin of a musical instrument.

U.S. Pat. No. 6,696,626 issued Feb. 24, 2004 shows an endpin holder anchored to the legs of a chair using an adjustment strap.

Despite the many endpin holders of the prior art, cellists still experience slight movements and continue to not have the confidence that endpin holders will not slip during a performance or practice. As a result many cellists refuse to use them. Instead, cellists still prefer to sharpen the end of the endpin and jam it into the floor. This is often inappropriate or impossible on a stone, tile, or cement floor. Certain carpet may also need protection from the sharpened endpin.

The instant invention provides a solution for this long felt need for completely trustworthy endpin restraint and floor protector.

SUMMARY OF THE INVENTION

It is a general object of the present invention to provide a secure endpin anchor and floor protector for use with the endpin of a stringed musical instrument, such as a cello or bass, which maintains the integrity of the floor surface.

It is one object of the present invention to provide a secure endpin anchor for a stringed musical instrument which is easily placed and is independent of the chair.

It is also an object of the present invention to provide an endpin holder whose position on the floor can be easily adjusted, but once adjusted will not be subject to even the slightest movement while in use.

A still further object of the present invention is to provide an endpin holder which is so small that it is it extremely easy to carry in the cello case accessory pocket within the case of the endpin equipped musical instrument.

Another objective is to provide an aesthetically attractive endpin holder.

It is a further object of the present invention to provide an endpin restraining arrangement having long-lasting, inexpensively produced components.

It is an additional object of the present invention to provide an endpin restraint which maintains a low profile in use.

In one aspect of the invention, an endpin holder is provided for a stringed musical instrument having an endpin projecting from the bottom surface therefrom and engaging the holder to prevent contact of the endpin with a floor surface as a musician is seated upon a chair holding the musical instrument. The invention is improved by an arrangement for stably fastening the holder directly to the floor and without interconnecting the endpin holder to the chair.

In still another aspect of the invention an endpin holder is provided for a stringed musical instrument having an endpin projecting wherein the holder is prevents direct contact of the endpin with a floor surface and is removably attached to the floor surface. The holder includes a substrate with top surface including means—a recessed hole—for receiving the endpin of the instrument. Affixed to the bottom of the substrate is a pressure sensitive adhesive which contacts and bonds with the floor. The pressure sensitive adhesive is bonded to an intermediate substrate (such as Polyurethane) which provides a bond between the adhesive and the substrate. With this arrangement the first surface prevents the endpin from direct contact with the floor and moving relative to the floor and stabilizes the endpin to hold the instrument in a desired position.

The holder is preferably made of rigid material. Preferably the pressure sensitive adhesive is of sufficient hardness that dirt and contaminants are not easily imbedded in the surface. In addition it is preferable that the pressure sensitive adhesive wets thoroughly with a solution of detergent or soap wetting agent so that when washed, the contaminants are released from the surface but once dry the pressure sensitive adhesive's tack and peel strength is restored. Still further the pressure sensitive adhesive uses little or no solvent and is silicdne based.

In accordance with the invention a restraint for an endpin of an instrument that rests on a floor is provided. The restraint has an upper surface which preferably has a recess adapted to receive the endpin and maintain it in a stable position. The lower surface of the restraint is coated with a pressure sensitive which adheres to the floor by the application of pressure applied from the upper surface toward the floor, but can be removed by the applying a force in a different direction.

According to the invention the adhesive allows said restraint to be adhered and removed from the floor on multiple occasions and is washable. The adhesive may be attached to the lower surface of the restraint by an intermediate substrate, wherein the pressure sensitive adhesive is bonded to the intermediate substrate and the intermediate substrate is bonded to the lower surface of the restraint. Still further, the pressure sensitive adhesive is of sufficient hardness that dirt and contaminants are not easily embedded in the coating of the lower surface of the restraint.

According to the invention when the pressure sensitive adhesive is washed with a solution of detergent or a soap wetting agent, contaminants are released from said surface. After said washing, when said pressure sensitive adhesive is dry, the pressure sensitive adhesive's tack and peel strength are substantially restored.

Various other objects, features and advantages of the invention will be made apparent from the following description taken together with the drawings.

BRIEF DESCRIPTION OF THE DRAWINGS

The drawings illustrate the best mode presently contemplated for carrying out the invention.

In the drawings.

DETAILED DESCRIPTION OF THE PREFERRED EMBODIMENTS

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

Figure 1:
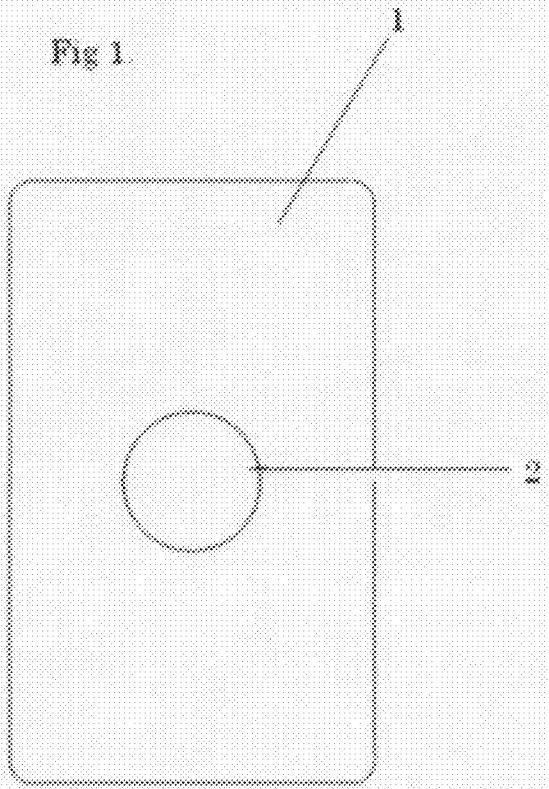
FIG. 1 is a top view of the holder of the invention

In FIG. 1 a holder with a rectangular body 1 is shown. It is understood that shape of the body can also be oval, square or any shape provided that it provides support for the instrument to be held in place on the floor. Preferably the holder is about 3-6 square inches in size. The holder has a top surface 4 which includes a round recess 2 which is adapted to hold the distal end of the endpin or post-like leg of the instrument to be held in place on the floor. The size of recess 2 is such that it is sufficient to accept the endpin or post-like leg of the instrument to be held in place on the floor.

Figure 3:
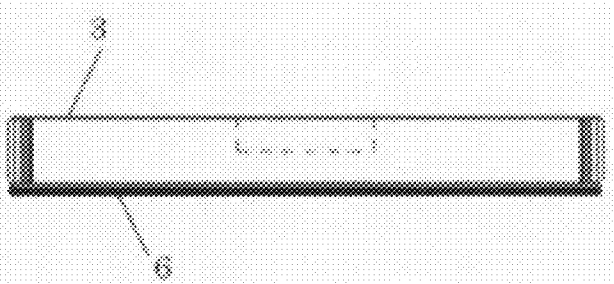
FIG. 3 is an end view of the holder of the invention.

The bottom surface 6 of the holder is shown in FIG. 3. The bottom surface is a pressure sensitive adhesive and is affixed to the primary material 5 of the holder which will also be referred to herein as the substrate.

Pressure sensitive adhesives ("PSAs") generally come in three chemistries depending on their base polymers: rubber-based, acrylic, and silicone. The silicone PSAs generally bond the best to low energy substrates and typically have a low tack and low to moderate peel strength.

Rubber-based PSAs adhere to a wider variety of surfaces than do acrylic adhesives, although they have a narrower service temperature range and do not resist UV as well. Rubber-based adhesives are highly compounded, and they are typically the best and most cost effective choice for less demanding applications.

The acrylic PSAs fill the gap between silicones and rubber-based adhesives in terms of cost and performance. They require fewer additives than rubber-based adhesive for optimal performance, and acrylic PSAs provide many advantages over rubber-based PSAs. They exhibit outstanding tack and peel strength and are second only to silicone in terms of yellowing and oxidations.

Silicone formulations have the highest temperature and chemical resistance by far, but they are expensive and provide less aggressive bonds than do acrylics or rubber-based adhesives. Silicone PSAs generally demonstrate lower tack and peel strength than other adhesive systems.

Because of their relatively low surface energy, about 21 $mJ/m^2$, silicone PSAs will bond well to both high- and low-energy surfaces, including etched polytetrafluoroethylene and unetched polyolefins, polyester, and fluorohalocarbon films. Silicone PSAs are the only adhesive that will consistently bond to silicone substrates.

Silicone adhesives are especially valuable when affixed to low energy substrates such as polyester or fluoropolymer. They can be used with substrates made from high density polyethylene, ultra high molecular weight polyethylene, polypropylene, polyvinyl chloride, acrylics, nylon, stainless steel, Teflon, wood and the like.

Silicone PSAs are comprised of two major components: a flexible, elastic silicone gum (either all methyl based or phenyl modified) and a hard, crystalline siloxane resin. The gum is a silanol containing high molecular weight polydimethylsiloxane (PDMS) or polydimethyldiphenylsiloxane (PDMDPS), and this is usually referred to as the "polymer" segment in the formulation. The "resin" segment consists of a siloxane resin copolymer of M, (CH3)3SiO½, and Q, SiO4/2, units; it is often referred to as an MQ resin.

Figure 4:
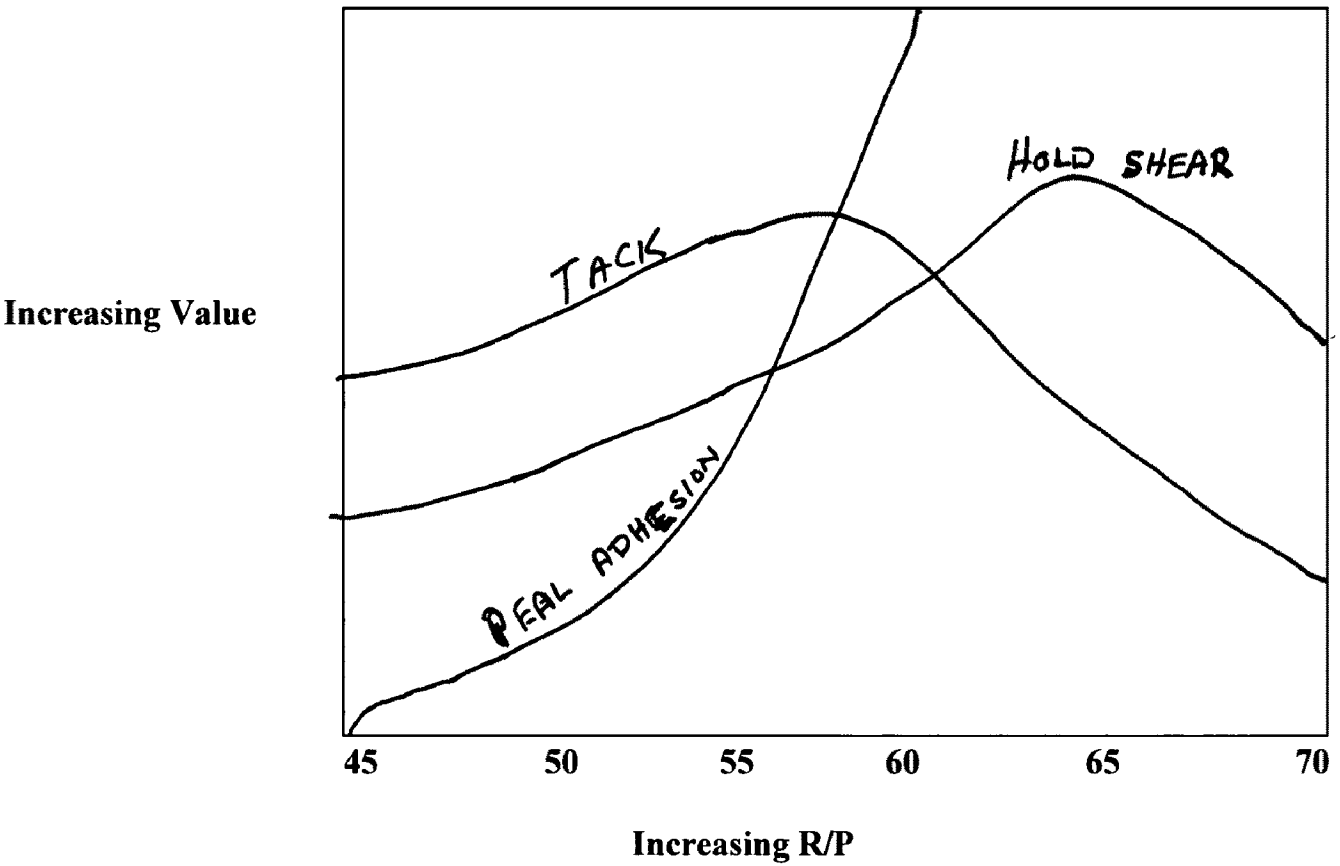
FIG. 4 is a chart which illustrates the affect of different resin/polymer ratios on tack, peel, and shear.

The properties of the adhesive will vary with the concentrations of these two basic ingredients. The ratio of the resin to polymer is the most important formulation detail when trying to optimize the balance of performance properties with a given adhesive. FIG. 4 shows the affect of different resin/polymer ratios on tack, peel, and shear.

Tack is greater with higher percentages of polymer, and cohesive strength as measured by shear or peel strength is greater with higher percentages of resin. The peel adhesion of silicone PSAs increase proportionally to the resin content until the adhesive becomes too dry, whereas the tack decreases with increasing resin content. The shear strength of a cured silicone PSA also depends strongly on resin content. These relationships hold true for both crosslinked and non-crosslinked silicone adhesive systems.

High resin content adhesives are not tacky at room temperature, but they gain tack with heat (93° C.) and pressure (7 kg/cm). These adhesives have been found to be excellent laminating adhesives for both films and foils.

Another method of formulating adhesive to a specific set of end-properties is to use the option of either methyl-based or phenyl-based polymers. Properties of methyl- and phenyl-based silicone PSAs are shown in Table 1. The polydimethylsiloxane type is the most prevalent. The phenyl adhesives are not compatible with methyl adhesives and other methyl polymers. However, polydimethylsiloxane polymers may be developed with some content of diphenyl siloxane units. In general, the addition of phenyl groups increase the peel performance of silicone based PSAs.

TABLE 1

Properties of Typical Methyl- and Phenyl-Based Silicone PSAs

| Type | Viscosity, cps | Peel Adhesion, g/cm | Lap Shear Strength, kg | Tack |
|---|---|---|---|---|
| Methyl | 65,000 | 445 | 33 | Medium |
| | 3000 | 535 | 60 | Low |
| | 9000 | 1000 | 68 | Tack-free |
| | 4800 | 714 | 50 | High |
| Phenyl | 75,000 | 500 | 39 | 305 |
| | 15,000 | 890 | 45 | 365 |

These silicone PSA constituents are dissolved in a solvent (generally up to 60% toluene or xylene) and chemical polymerization generally occurs via a condensation reaction as shown in FIG. 1. SiOH groups become polymerized and the water that is formed is removed from the system through evaporation. For crosslinking, benzoyl peroxide and cure temperatures of at least 150° C. are mostly utilized.

Silicone pressure sensitive adhesives can be used in cured (crosslinked) or uncured (non-crosslinked) condition. Curing improves the high temperature shear properties with a slight loss of peel compared to the noncured adhesive. Silicone pressure sensitive adhesive can be cured using three different catalyst systems: benzoyl peroxides, amino silanes, and platinum.

An alternative to the catalyzed systems described above use a completely different type of curing mechanism. These adhesive are cured by a platinum catalyzed addition reaction. A typical adhesive of this type contains a high viscosity vinyl (endblocked polydimethylsiloxane), a silicone hydride (methylhydrogensilicone), and a platinum catalyst.

The product is a low viscosity mixture requiring little or no diluents; it provides a cured PSA with high peel and tack adhesion properties. These formulations have been used in silicone PSAs that have very low solvent concentrations. Unlike the other silicone systems, which require solvent for dissolving the components, platinum catalyzed silicone PSAs only require the solvent for viscosity control. In addition to adhesive systems, this chemistry is used to produce solventless silicone release coatings.

The curing of platinum catalyzed silicone PSA can be accomplished in a single zone oven at temperatures in the range of 100-150° C. In addition to lower VOCs, the benefits include faster line speeds, lower sensitivity to temperature variation, compatibility with temperature sensitive substrates, and no generation of volatile by-products on cure.

Figure 2:
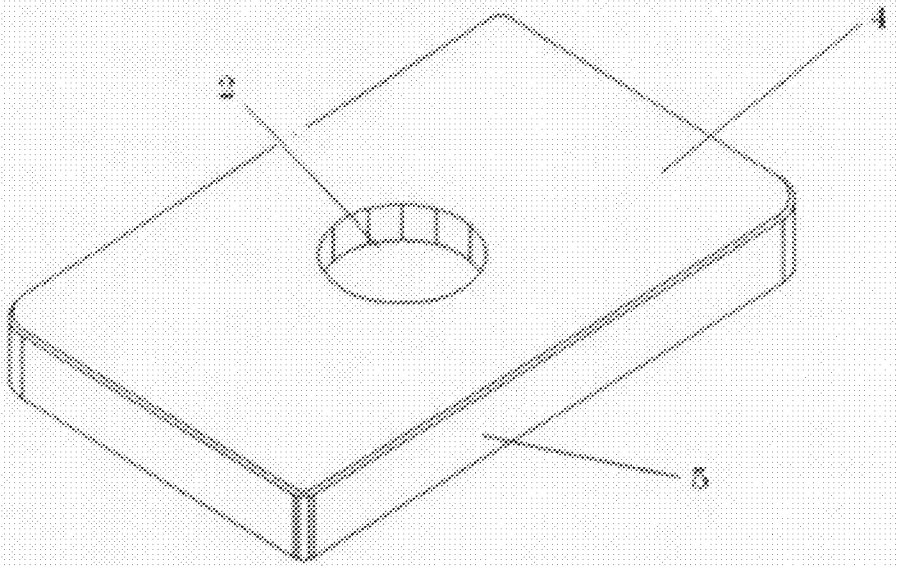
FIG. 2 is a perspective view of the holder of the invention

There are many PSA's available. Preferably the PSA used to make surface 4 of FIG. 2 has a peel adhesion of 30-65 oz/inch and a probe tack of 500-1200 g/cm2 (low tack). Preferably the PSA should also adhere to low energy surfaces. Manufacturing is easiest when the PSA does not contain a solvent.

It will thus be seen that the objects of the invention set forth above, among those made apparent from the preceding description, are efficiently attained and, since certain changes can be made in carrying out the above improved end pin holder without departing from the spirit an scope of the invention, it is intended that all matter contained in the above description and shown in the accompanying drawings shall be interpreted as illustrative and not in a limiting sense.

It is also understood that the following claims are intended to cover all of the generic and specific features of the invention herein described and all statements of the scope of the invention which as a matter of language might be said to fall therebetween.

What is claimed is:

1. A restraint for an endpin of an instrument that rests on a floor comprising:

an endpin holder having an upper and a lower surface;

wherein said upper surface contains means for maintaining said endpin in a stable position;

wherein said lower surface is coated with a pressure sensitive adhesive;

wherein said pressure sensitive adhesive adheres to the floor by the application of pressure applied on said upper surface of said holder in a downward and first direction;

and wherein said holder can be adhered to and removed from the floor on multiple occasions.

2. A restraint for an endpin of an instrument according to claim 1 wherein said upper surface comprises a recess adapted to receive said endpin.

3. A restraint for an endpin of an instrument according to claim 1 wherein said pressure sensitive adhesive is washable.

4. A restraint for an endpin of an instrument according to claim 1 further comprising an intermediate substrate, wherein said pressure sensitive adhesive in bonded to said intermediate substrate and said intermediate substrate is bonded to said lower surface.

5. A restraint for an endpin of an instrument according to claim 3 wherein said pressure sensitive adhesive is of sufficient hardness that dirt and contaminants are not easily embedded in said coating of the lower surface.

6. A restraint for an endpin of an instrument according to claim 5 wherein when said coating of pressure sensitive adhesive has contaminants embedded in such coating and is washed with a solution of detergent or a soap wetting agent, some or most of said contaminants are released from said coating, and after said washing, when said pressure sensitive adhesive is dry, said pressure sensitive adhesive's tack and peel strength are substantially restored.

7. A restraint for an endpin of an instrument according to claim 5 where said pressure sensitive adhesive is silicon based.

8. A restraint for an endpin of an instrument according to claim 5 wherein said restraint comprises substantially wood or a hard plastic.

9. A restraint for an endpin of an instrument according to claim 7 wherein said restraint comprises a low energy substrate.

10. A restraint for an endpin of an instrument according to claim 7 wherein said pressure sensitive adhesive does not contain a solvent.

11. A restraint for an endpin of an instrument according to claim 5 wherein said pressure strength adhesive has a peel adhesion of 30-65 oz/inch and a probe tack of 500-1200 g/cm2.

* * * * *